US006142592A

United States Patent [19]

Grittke et al.

[11] Patent Number: 6,142,592

[45] Date of Patent: Nov. 7, 2000

[54] INSTRUMENT SYSTEM

[76] Inventors: Udo Grittke, Grossmannstr. 17, 79541 Lörrach; Armin Rupp, Landskronstr. 24, 79576 Weil/Rhein; Thomas Werner, Postfach 1128, 79689 Maulburg, all of Germany

[21] Appl. No.: 09/301,236

[22] Filed: Apr. 28, 1999

[30] Foreign Application Priority Data

May 19, 1998 [DE] Germany ..... 98109069

[51] Int. Cl.[7] ..... A47B 97/00; H01R 13/64

[52] U.S. Cl. ..... 312/223.1; 439/681

[58] Field of Search ..... 312/248, 293.1, 312/293.2, 293.3, 223.1, 223.6; 439/680, 681

[56] References Cited

U.S. PATENT DOCUMENTS

| | | | |
|---|---|---|---|
| 4,747,792 | 5/1988 | Strate | 439/681 |
| 4,813,892 | 3/1989 | Strate | 439/681 |
| 5,392,194 | 2/1995 | Zell et al. | 361/785 |

FOREIGN PATENT DOCUMENTS

| | | | |
|---|---|---|---|
| 0 422 568 | 4/1991 | European Pat. Off. . | |
| 2642231 | 7/1990 | France | 439/680 |
| 2807017 | 8/1979 | Germany . | |
| 3014804 | 10/1981 | Germany . | |
| 586962 | 4/1977 | Switzerland | 439/681 |
| 1243367 | 8/1971 | United Kingdom | 439/681 |
| 2 253 096 | 8/1992 | United Kingdom . | |

*Primary Examiner*—Peter M. Cuomo
*Assistant Examiner*—James O. Hansen
*Attorney, Agent, or Firm*—Bose McKinney & Evans LLP

[57] ABSTRACT

An instrument system having at least one instrument disposed in a housing (1) the housing is to be mounted detachably on a support (3) and a user is to set a coding for each system module comprising instrument and support. Grooves (23 or 27) are provided in the support (3) for taking up coding pins (31). In the assembled state the grooves (23) of the support form groove pairs with the grooves (27). The inner spaces of the grooves of a groove pair together form an interstice for accommodating just one coding pin (31). This is fixed in either the groove (27) or in the groove (23). In this way the assignment of a housing (1) to a support (3) is established through the positions of the coding pins (31).

13 Claims, 4 Drawing Sheets

INSTRUMENT SYSTEM

FIELD OF THE INVENTION

The present invention relates to an instrument system having at least one instrument disposed in a housing, in which the housing is mounted detachably on a support.

BACKGROUND OF THE INVENTION

In applications such as inspection, control and automation of complex processes normally utilized in metrology, it is usual to make use of a number of measuring instruments such as instruments for measuring temperature, pressure, flow rate or level at the same time. A measuring instrument generally consists of a measuring sensor and an evaluation instrument or switching instrument arranged at a distance therefrom. The instruments have to be switched on individually, that is, they have to be supplied with power and, if required, signal lines have to be connected to the instruments and lead away from them.

For this reason, in industrial plants switchboards are usually installed accommodating a plurality of instruments which are spatially closely adjacent to one another. These instruments are set on supports provided therefor and are fastened detachably onto their respective supports by means of snap locks or screw plugs. The supports are fitted to a wall, for instance, or are snap-locked to a rail, particularly a top hat rail.

For reasons of safety and functionality of such plants it is particularly important that assignment of the individual instruments to the supports provided for them is carried out correctly. Any faulty setting and accordingly incorrect wiring of the corresponding instruments can have fatal consequences.

DE-A 39 33 703, corresponding to EP-A 422 568, discloses an instrument system having at least one instrument disposed in a housing, wherein the housing is mounted detachably on a top hat rail. Embedded in the top hat rail is a plastic profile in which electrical wiring is arranged to which the instrument is connected when locked on to the top hat rail.

Attached to a rear wall of the instruments facing the plastic profile is a guide pin which engages in a corresponding recess in the plastic profile when the instrument is locked on. The guide pin can also be used for coding. Coding pins can also be set into the plastic profile, which engage on the underside of the instrument when it is set in corresponding recesses.

SUMMARY OF THE INVENTION

A drawback to this type of instrument system is that the coding on the individual instruments is set by their manufacturers, that is, the position of the recesses on the underside of an instrument or the position of the guide pin is unalterable. For an customer using a number of instruments of the same type it is not possible to distinguish between the individual instruments.

But this is necessary, for example, whenever several instruments of the same type are used for different purposes, and therefore different executable programs or behavior patterns can be programmed or installed in the individual instruments.

An object of the present invention is to propose an instrument system having at least one instrument disposed in a housing, wherein the housing is mounted detachably on a support and wherein the customer himself can set a coding for each system module comprising an instrument and a support.

To solve this task the invention comprises an instrument system having at least one instrument disposed in a housing, wherein

- the housing is detachably mounted on a support,
- first grooves are disposed in the support,
- second grooves are disposed in the housing for taking up coding pins,
- in the assembled state one groove belonging to the first grooves forms a groove pair with one groove belonging to the second grooves,
- the inner spaces of both grooves of a groove pair together form an interstice for accommodating just one coding pin,
  - which is fixed in either a groove belonging to the first grooves,
  - or in a groove belonging to the second grooves, and
- the assignment of the housing to the support is established by the positions of the coding pins.

In accordance with a first preferred embodiment of the present invention the inner spaces of the grooves exhibit T-shaped cross-sections with a T-head and a T-foot, and bring the grooves of a groove pair into contact with the T-foot.

In accordance with a second preferred embodiment of the present invention the coding pins comprise a rod and an extension formed thereon, and in the assembled state the rod is disposed in a first groove of a groove pair and in the assembled state the extension is disposed at least partially in a second groove of the groove pair.

In accordance with a third embodiment of the present invention each coding pin exhibits a clamping device disposed in one of the grooves for their detachable fastening.

An advantage of the invention is that by positioning the coding pins the customer can adjust the coding of the instruments tailored precisely to his requirements. Accordingly, identical instruments can also be assigned to a particular support.

The invention and further advantages will now be explained in greater detail with reference to the figures of the drawings illustrating an embodiment; identical parts are provided in the figures with the same reference numerals.

DETAILED DESCRIPTION OF THE DRAWINGS

Figure 1:
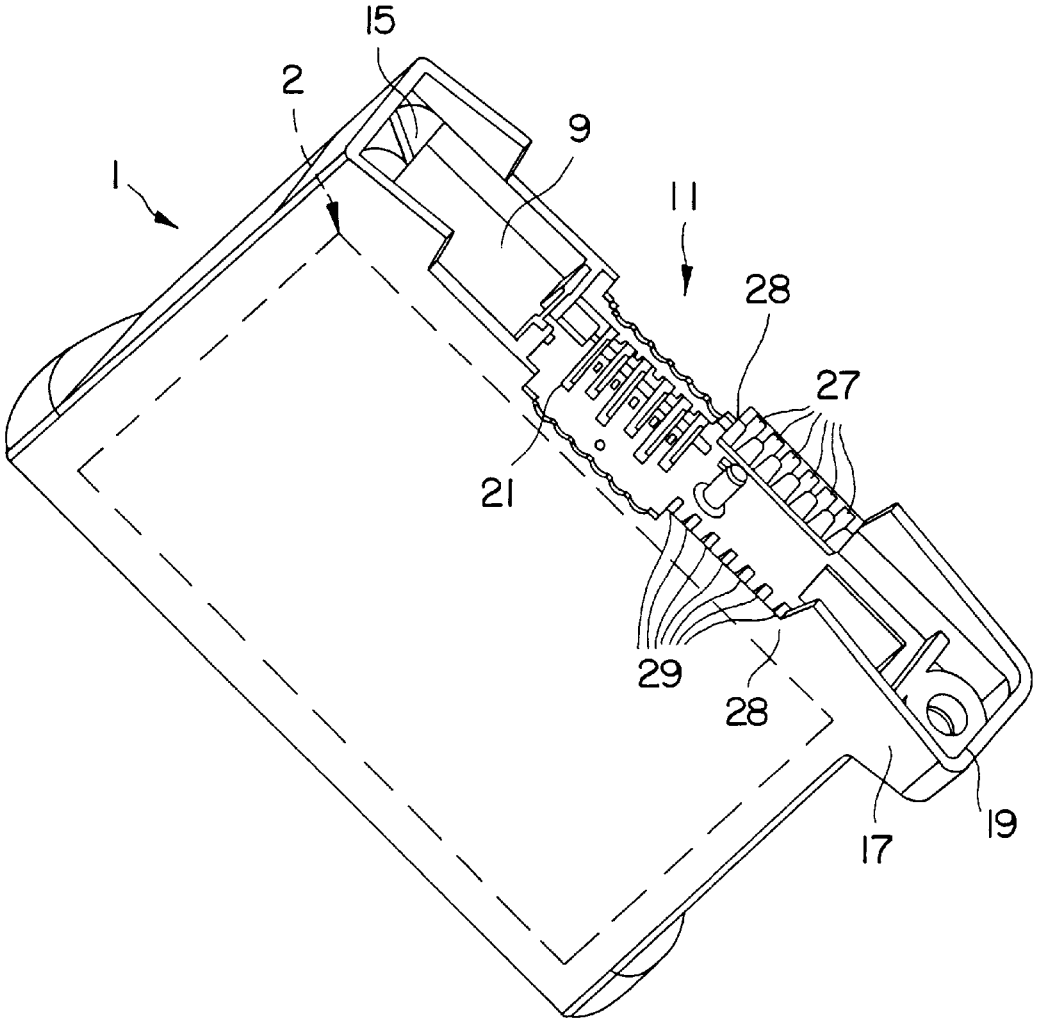
FIG. 1 shows a housing in perspective from below.

FIG. 1 illustrates in a perspective rear view a housing 1 of an instrument 2. An instrument system according to the present invention exhibits at least one instrument 2 disposed in housing 1. This is, for instance, an evaluation portion or switching portion of an instrument for measuring level, pressure, flow rate or temperature. The instrument is to be fixed in place mechanically and is to be connected electrically.

Figure 2:
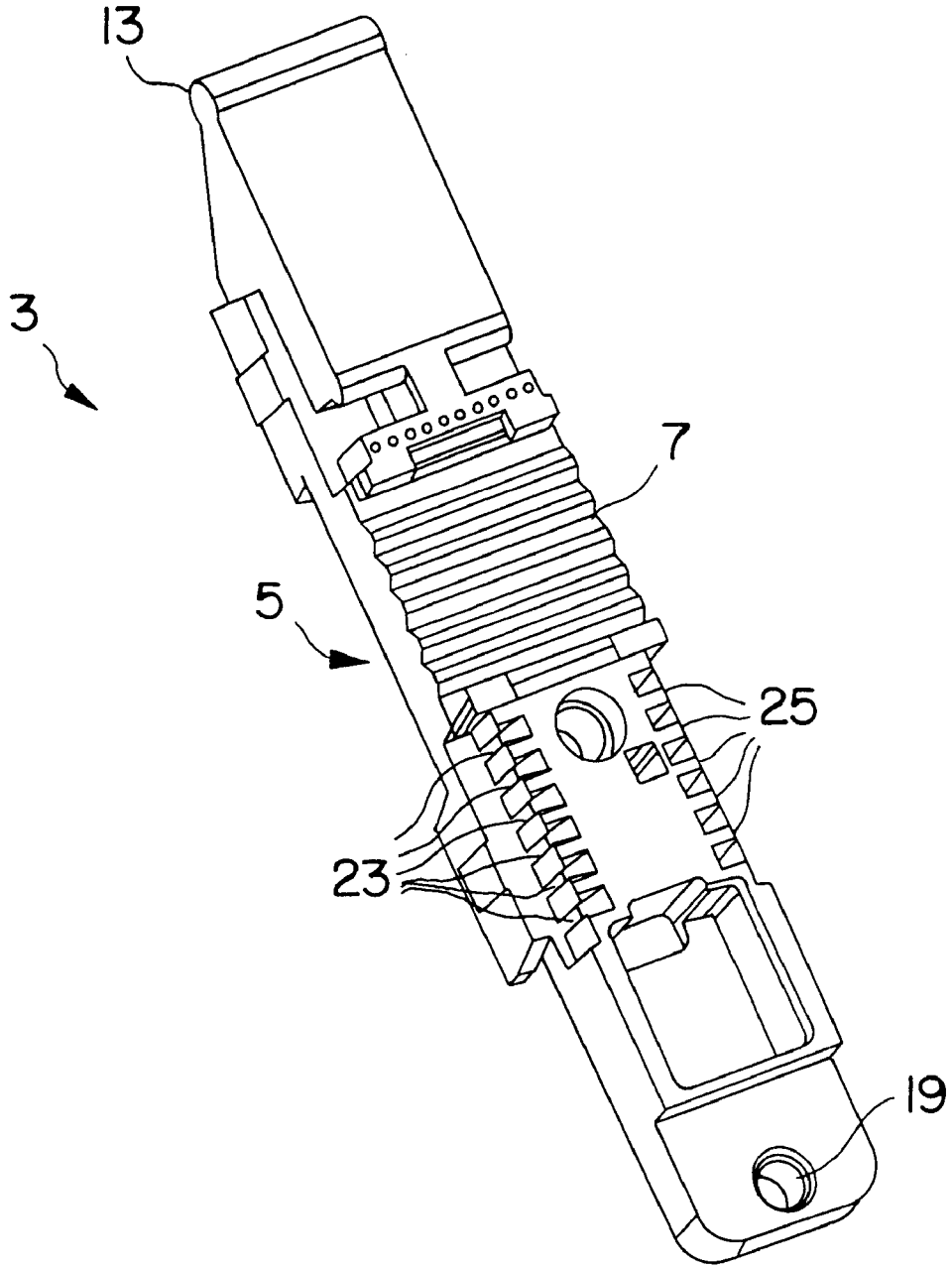
FIG. 2 shows a support in perspective from the front.

FIG. 2 illustrates in perspective a support 3 with a view of a front side, which serves as said mechanical fastening.

On a rear side support 3 exhibits a snap-in mounting, obscured in this view, with which support 3 can be locked onto a rail, for example a top hat rail screwed onto a wall. Support 3 can, however, be screwed directly onto a wall.

On the front side of support 3 there is provided a cable mounting 7 in which a cable, for example a multiwire ribbon cable not illustrated in FIG. 2, is to be laid. Housing 1 is mounted detachably on support 3. On a rear side 9 of housing 1 facing support 3 there is provided a recess 11 which in form essentially matches the front side of support 3. An end of support 3 exhibits a rounded shoulder 13, on which housing 1 is set pivotably during assembly.

At the end in recess 11 housing 1 comprises an undercut 15 which envelops shoulder 13. By rotation of housing 1 about an axis formed by shoulder 13, housing 1 is set on support 3. On the side of housing 1 opposite undercut 15 there is formed a projection 17 having a borehole 19, through which a fastening screw, not illustrated in the figures, can be screwed into support 3. On its underside housing 1 also exhibits edge contacts 21 which project into recess 11 and, in the assembled state, create an electrical contact with wires of a cable laid in cable mounting 7.

Support 3 is provided on each side wall with adjacent first grooves 23 which run vertically to the front surface of support 3 and which are open to the front surface of support 3, as well as to the associated side wall.

Figure 3:
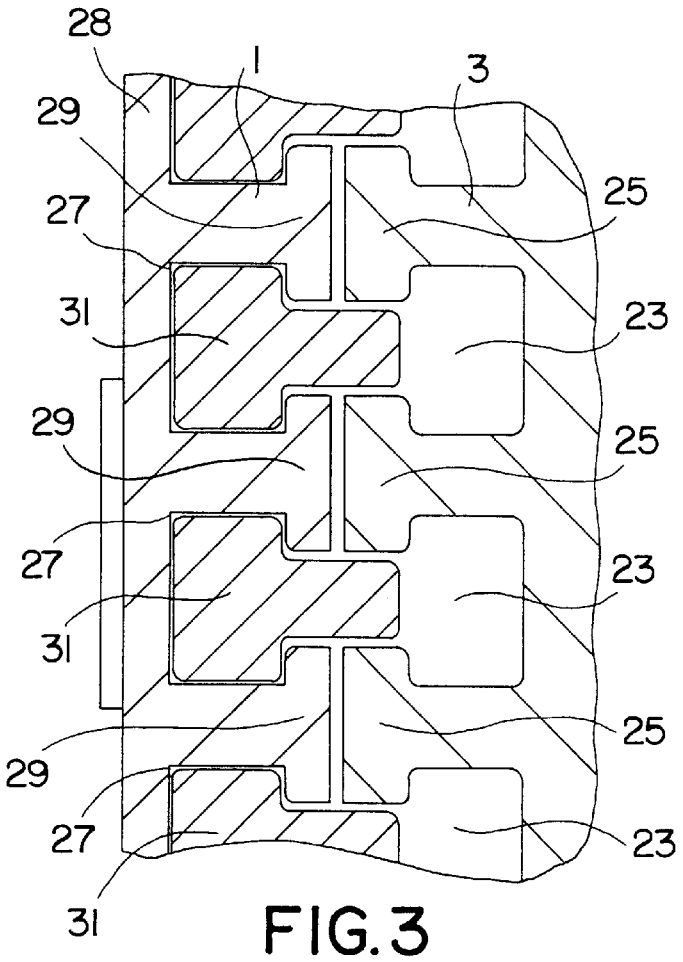
FIG. 3 shows a longitudinal section through a portion of support and housing in the assembled state, in which several groove pairs each comprising a groove disposed in the housing and a groove disposed in the support lie.

As illustrated in FIG. 3, the inner spaces of grooves 23 have a T-shaped cross-section, and two adjoining grooves 23 are separated from one another by a bridge 25, also in a T-shape. Disposed in housing 1 are second grooves 27 identical in form to grooves 23. These are located in two opposing side walls 28 of housing 1 which delimit recess 11.

The inner spaces of grooves 27 also have a T-shaped cross-section, and two adjacent grooves 27 are separated from one another by a T-shaped frame 29. Each of these T-shapes has a T-beam and a T-foot having a bottom surface.

Grooves 27 are open to the rear side of housing 1 facing support 3 and also to the center of recess 11. Grooves 23, 27 are disposed in such a way that in the assembled state a groove belonging to first grooves 23 forms a groove pair with a groove belonging to second grooves 27. In this way a groove 27 of housing 1 is spatially assigned to each groove 23 of support 3. Two grooves 23 and 27 of a groove pair are adjacent to the associated bottom surface.

Housing 1 with its side wall 28 and T-shaped frames formed thereon is illustrated in the left half of FIG. 3. Support 3 with T-shaped frames 25 formed thereon is to be seen in the right half of FIG. 3. The inner spaces of the opposing grooves of each groove pair together form an interstice whose cross-section now has an H-shape. The groove pairs serve to accommodate coding pins 31.

Figure 4:
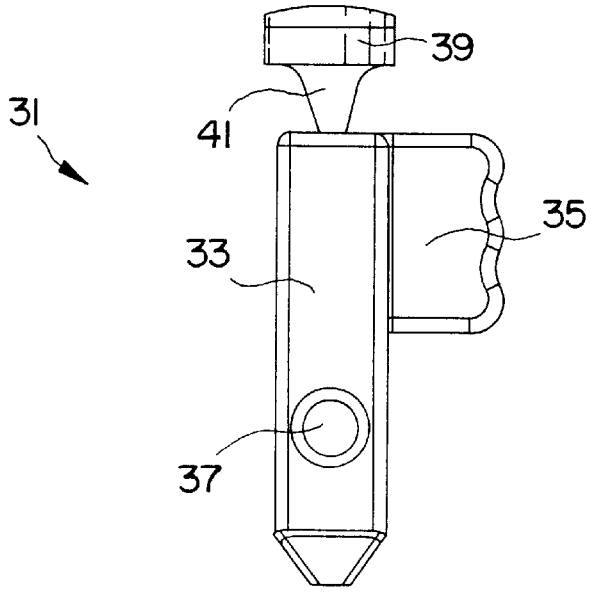
FIG. 4 shows a coding pin.

FIG. 4 illustrates such a coding pin 31. This pin comprises a rod 33 having a longitudinal axis, and an extension 35 formed at one end of rod 33, extending at a right angle to the longitudinal axis. Each coding pin 31 can be fixed in a groove 23 associated with the first grooves or in a groove 27 associated with the second grooves.

In this way assignment of housing 1 to support 3 is clearly established through the positions of coding pins 31 in grooves 23 or 27. For illustration purposes, three coding pins 31 are positioned in three grooves 27 of housing 1 in FIG. 3.

The coding pins 31 are inserted with the end of rod 33 averted from extension 35 front-first into grooves 23 or 27. Extension 35 runs at a right angle to rod 33 through the T-foot of corresponding groove 27 through into the T-foot of opposite groove 23 of support 3.

Respectively opposite grooves 23 and 27 in FIG. 3 form a groove pair. The dimensions are such that the interstice which is formed by the inner spaces of grooves 23, 27 of a groove pair, is suited to snugly accommodate a coding pin 31. There is not sufficient space available in the interstice for a second coding pin, since extension 35 of a coding pin 31 disposed in a first groove 23 or 27 extends into the inner space of second groove 27 or 23 of the groove pair contiguous with first groove 23 or 27.

Each coding pin 31 has at least one protuberant clamping device on the end averted from extension 35; in the embodiment of FIG. 3 this has the form of a protuberant clamping nose 37. When a coding pin 31 is brought into place, it is clamped tight in groove 23 or 27.

The coding pins 31 are thereby fixed detachably in grooves 23, 27. A spring-loaded burl or other type of clamping device may also be used for this detachable fastening. With each coding pin 31, which is fixed in a groove 23 or 27, its extension 35 projects out from groove 23 or 27. By hand or by using a screwdriver the customer can reach under extension 35 to remove coding pin 31.

Figure 5:
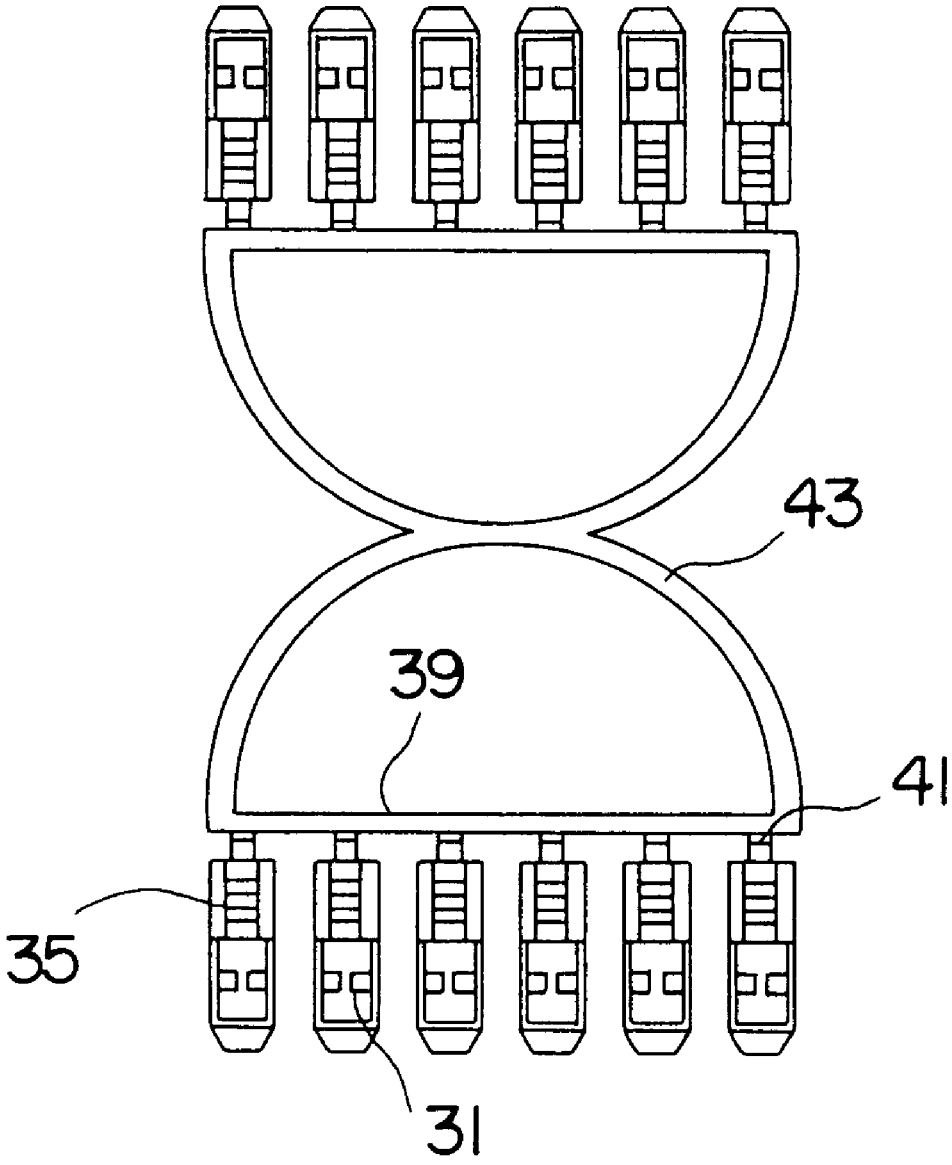
FIG. 5 shows several coding pins disposed on a mounting auxiliary.

During assembly of housing 1 and support 3 all grooves 23 or all grooves 27 can be fitted with coding pins 31 by the manufacturer. An assembly auxiliary, for example as illustrated in FIG. 5, can be utilized for this purpose. This comprises a strip 39, to which coding pins 31 are attached next to one another by means of narrow bridges 41. The ends of coding pins 31 displaying extension 35 are facing strip 39. The number of coding pins 31 on a strip 39 is equal to the number of grooves 23 or 27 disposed in housing 1 or on support 3.

The distance between coding pins 31 is made equal to the distance between adjoining grooves 23 or 27. Formed on strip 39 is a grip 43. The assembly auxiliary is gripped by grip 43 and all coding pins 31 attached thereto are inserted into grooves 23 or 27 at the same time. Then, the predetermined breaking points formed by bridges 41 are separated by forward snapping of grip 43, and strip 39 and grip 43 are removed.

With the abovementioned assembly of housing 1 and support 3 coding pins 31 are preferably disposed in housing 1, therefore in grooves 27. The customer himself can then carry out his own coding best suited to his requirements by removing individual coding pins 31 from grooves 27 and inserting them into grooves 23 of support 3 assigned thereto. Marks such as color markings, letters or figures are preferably provided to identify both grooves 23 and 27 of a groove pair.

The assignment of a special housing 1 to a special support 3 is clearly established by the positions of coding pins 31. This special housing 1 can be mounted on this special support 3 only when a single coding pin 31 is disposed in the groove pair formed thereby.

Whenever n groove pairs (n greater than or equal to 2) are provided, there are also n coding pins 31; then the number of possible different codings comes to 2n. In the case of twelve groove pairs this is already 4096 different codings.

The number of possible codings can also be increased by augmenting the number of grooves. For this purpose a partition can be incorporated in the center of recess 11 of housing 1, which is provided with additional grooves on one or both sides. The counterpart to this is, for instance, a support having a complementary recess, on the inner walls of which are disposed the associated grooves.

Also, two supports could be provided in combination with such a housing. With very wide housings there is the possibility of forming their rear wall in such a way that this housing can be mounted simultaneously on at least two supports.

The customer can define an optimized coding scheme for his own uses. For example, he can use a few of coding pins 31 in order to mark the instrument type, and then use others to indicate specific insertion points for more instruments of the same type.

The manufacturer-specified arrangement of coding pins 31 in housing 1 offers the advantage where the customer is compelled to undertake conscious handling during installation of a replacement instrument. He has to remove coding pins 31 corresponding to the coding on support 3 from housing 1 of the replacement instrument.

In the process, monitoring of the system inevitably takes place, effectively reducing the risk of faulty assembly. If the coding is selected such that both insertion point and instrument type are visible, the customer is occasioned to monitor both these parameters during assembly of a replacement instrument. This applies similarly to other parameters whenever a coding is selected which contains information on further parameters.

What is claimed is:

1. An instrument system for at least one instrument, comprising:

a support comprising a first support groove and a second support groove, each of said first support groove and said second support groove having a T-shaped cross section comprising a T-head and a T-foot;

a housing detachably mountable to said support and suited for mechanically fixing said at least one instrument therein, said housing comprising a first housing groove and a second housing groove, each of said first housing groove and said section housing groove having a T-shaped cross section with a T-head and a T-foot; and a plurality of coding pins that each comprise a rod and an extension formed thereon, said rod of each coding pin configured to be detachably disposed in said T-head portion of any one of said first housing groove, said second housing groove, said first support groove, and said second support groove, said extension of said rod configured to be disposed in and extend through said T-foot portion corresponding to said T-head portion in which said rod is detachably disposed, wherein said first support groove and said first housing groove form a first groove pair having an H-shaped cross section in which said T-foot portion of said first support groove adjoins said T-foot portion of said first housing groove when said housing is mounted to said support, said second support groove and said second housing groove form a second groove pair having an H-shaped cross section in which said T-foot portion of said second support groove adjoins said T-foot portion of said second housing groove when said housing is mounted to said support, and said extension of said plurality of coding pins prevents said housing from being securely mounted to said support if any one groove pair selected from said first groove pair and said second groove pair comprises more than one coding pin disposed therein.

2. The instrument system of claim 1, wherein said rod of each of said plurality of coding has a longitudinal axis, and said extension of each of said plurality of coding pins is formed at a first end of said rod an extends therefrom at a right angle to said longitudinal axis.

3. The instrument system of claim 2, wherein each of said plurality of coding pins further comprises at least one protuberant clamping nose toward a second end of said rod which is averted from said first end of said rod.

4. The instrument system of claim 1, wherein said support further comprises a shoulder and said housing further comprises an undercut configured to envelop said shoulder, said shoulder and said undercut defining an axis about which said housing pivotably rotates when being mounted to said support.

5. The instrument system of claim 4, wherein said support further comprises a first borehole at an end opposite said shoulder, said housing further comprises a second borehole at an end opposite said undercut and aligned with said first borehole such that when said housing is mounted to said support a fastening screw may pass though second borehole of said housing and be screwed into said first borehole of said support.

6. The instrument system of claim 1, wherein said support further comprises a cable mounting operable to receive a ribbon cable comprising a plurality of wires, and said housing further comprises a plurality of edge contacts which provide the at least one instrument with electrical contact with said plurality of wires when said housing is mounted to said support.

7. An instrument system for at least one instrument, comprising:

a support comprising a first support groove, a second support groove, and a cable mounting operable to receive a ribbon cable comprising a plurality of wires;

a housing detachably mountable to said support and suited for mechanically fixing said at least one instrument therein, said housing comprising a first housing groove, a second housing groove, and a plurality of edge contacts which provide the at least one instrument with electrical contact with said plurality of wires when said housing is mounted to said support; and a plurality of coding pins that each configured to be detachably disposed in any one of said first housing groove, said second housing groove, said first support groove, and said second support groove, wherein said first support groove and said first housing groove form a first groove pair when said housing is mounted to said support, said second support groove and said second housing groove form a second groove pair when said housing is mounted to said support, and said plurality of coding pins prevents said housing from being securely mounted to said support if any one groove pair selected from said first groove pair and said second groove pair comprises more than one coding pin disposed therein.

8. The instrument system of claim 7, wherein each of said first support groove and said second support groove have a T-shaped cross section comprising a T-head and a T-foot, each of said first housing groove and said section housing groove have a T-shaped cross section with a T-head and a T-foot; and each coding pin of said plurality of coding pins comprises a rod and an extension formed thereon, said rod being configured to be detachably disposed in said T-head portion of any one of said first housing groove, said second housing groove, said first support groove, and said second support groove, and said extension of said rod being configured to be disposed in and extend through said T-foot portion corresponding to said T-head portion in which said rod is detachably disposed.

9. The instrument system of claim 8, wherein said first groove pair has an H-shaped cross section in which said T-foot portion of said first support groove adjoins said T-foot portion of said first housing groove when said housing is mounted to said support, said second groove pair has an H-shaped cross section in which said T-foot portion of said second support groove adjoins said T-foot portion of said second housing groove when said housing is mounted to said support, and said extension of said plurality of coding pins prevents said housing from being securely mounted to said support if any one groove pair selected from said first groove pair and said second groove pair comprises more than one coding pin disposed therein.

10. The instrument system of claim 8, wherein said rod of each of said plurality of coding has a longitudinal axis, and said extension of each of said plurality of coding pins is formed at a first end of said rod an extends therefrom at a right angle to said longitudinal axis.

11. The instrument system of claim 8, wherein each of said plurality of coding pins further comprises at least one protuberant clamping nose toward an end of said rod which is averted from said extension.

12. The instrument system of claim 7, wherein said support further comprises a shoulder and said housing further comprises an undercut configured to envelop said shoulder, said shoulder and said undercut defining an axis about which said housing pivotably rotates when being mounted to said support.

13. The instrument system of claim 7, wherein said support further comprises a first borehole at an end opposite said shoulder, said housing further comprises a second borehole at an end opposite said undercut and aligned with said first borehole such that when said housing is mounted to said support a fastening screw may pass though second borehole of said housing and be screwed into said first borehole of said support.

* * * * *

UNITED STATES PATENT AND TRADEMARK OFFICE

CERTIFICATE OF CORRECTION

PATENT NO. : 6,142,592
DATED : November 7, 2000
INVENTOR(S) : Udo Grittke, Armin Rupp, and Thomas Werner It is certified that error appears in the above-identified patent and that said Letters Patent is hereby corrected as shown below:

On title page,

The following Assignee should be added:

Endress + Hauser GmbH + Co.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*